US005103936A

United States Patent [19]

Morikawa

[11] Patent Number: 5,103,936

[45] Date of Patent: Apr. 14, 1992

[54] SPRING DRIVE UNIT OF PULL-BACK WINDUP TYPE

[75] Inventor: Ryota Morikawa, Yoshikawa, Japan

[73] Assignee: Seikoken Kabushiki Kaisha, Tokyo, Japan

[21] Appl. No.: 533,675

[22] Filed: Jun. 5, 1990

[30] Foreign Application Priority Data

Jun. 14, 1989 [JP] Japan ..... 1-68603[U]

[51] Int. Cl.[5] ..... F03G 1/00; A63H 29/00

[52] U.S. Cl. ..... 185/39; 185/45; 446/464

[58] Field of Search ..... 446/462, 463, 464; 185/39, 45, DIG. 1

[56] References Cited

U.S. PATENT DOCUMENTS

| | | | |
|---|---|---|---|
| 2,672,216 | 3/1954 | Gokey | 185/45 X |
| 3,647,025 | 3/1972 | Paya Rico | 446/464 X |
| 3,995,718 | 12/1976 | Nakamori | 185/39 |
| 4,241,534 | 12/1980 | Larsson et al. | 446/464 |
| 4,710,147 | 12/1987 | Wakase | 446/464 |

*Primary Examiner*—Allan D. Herrmann
*Assistant Examiner*—Julie Krolikowski
*Attorney, Agent, or Firm*—Notaro & Michalos

[57] ABSTRACT

A thin spiral spring drive unit, in particular for a toy car, employs a crown gear in a gear train between an output shaft and a drive shaft on which a spiral spring is wound as a source of the driving force. The unit can be assembled with a small number of component parts, in a simple structure and at lower cost. Simply by changing the direction of the output shaft when it is assembled into a gear box, the direction of rotation of the output shaft may be changed. The crown gear in the drive unit is arranged at a position substantially centeral to the width of a gear box. A pinion is arranged at two positions where the crown gear intersects with the output shaft to be meshed with the crown gear by means of a positioning mechanism. The crown gear is provided on its periphery with a windup gear and with a driving pinion on the shaft thereof so that the windup gear is engaged with a gear at the time of winding while it is directly engaged with a driving gear at the time of driving.

7 Claims, 2 Drawing Sheets

SPRING DRIVE UNIT OF PULL-BACK WINDUP TYPE

FIELD OF THE INVENTION

This invention relates to a spring drive unit of a pull-back windup type which uses a spiral spring as a source of the driving force. More particularly, this invention relates to a pull-back windup spring drive unit of a thin type which employs a crown gear in a gear train between a driving shaft on which a spring is wound and an output shaft.

RELATED TECHNOLOGIES

There has been proposed in the relevant art a thin type pull-back windup spring drive unit as shown in FIG. 5. The drive unit reduces the thickness of a gear box by employing a crown gear 105 on the output shaft side of a gear train 102 connecting a drive shaft 104 on which a spiral spring 101 is wound and an output shaft 103, and arranging all the drive shafts except for the spring 101 and a driven pinion 106 on the output shaft 103 in the direction perpendicular to the output shaft 103. In the unit, the driven pinion 106 is arranged at a position deviated from the center of the width of the gear box 114 and a crown gear 105 is provided on the other side so that the crown gear 105 meshes on one side thereof with the driven pinion 106 at the substantial center of the width of the gear box 114. Between the crown gear 105 and the drive shaft 104 on which the spring 101 is wound are provided an idle gear 109 (which is generally called as a third gear) comprising a gear for windup gear 107 and a drive pinion 108 which are integrally molded coaxially, a windup gear 110, a drive gear 111, and a windup pinion 112 and a driving gear 113 which are coaxially formed with the drive shaft 104. When the spring is wound, the revolution is transmitted from the output shaft 103→the pinion 106→the crown gear 105→the windup gear 107 of the third gear 109→the windup gear 110→the windup pinion 112→the drive shaft 104→the spiral spring 101 while when the spring is unwound, the revolution is transmitted from the spiral spring 101→the drive shaft 104→the driving gear 113→the drive switching gear 111→the drive pinion 108 of the third gear 109→the crown gear 105→the driven pinion 106→the output shaft 103.

However, the relevant art drive unit is defective in that the revolution of the output shaft 103 is limited to one direction because the crown gear 105 is arranged eccentrically to one side of the gear box 114. Where the unit is used for a front driving unit of a toy car, the unit should be molded to have the frame structure and gear arrangement in the gear box opposite to the case when it is used for a rear driving unit of a toy car.

As the relevant art drive unit requires a third gear 109 which comprises integrally and coaxially a windup gear 107 and a drive pinion 108, the number of gears increases to thereby push up the production cost, and the thickness or the size of the gear box cannot be desirably minimized. This poses a serious problem in the case of drive units to be used as a power source of toys which are small and thin.

SUMMARY OF THE INVENTION

An object of this invention is to provide a spring drive unit of a pull-back windup type which can be made with a smaller number of component parts, and is simpler in structure and less expensive in cost than prior art. More particularly, this invention aims at providing a drive unit which permits for changing the rotational direction of the output shaft by simply turning the output shaft in a given, selected way within a gear box, and which can be made with a smaller number of parts and in a smaller size.

In order to attain those objects, the pull-back windup type spring drive unit according to this invention comprises a crown gear mounted in a gear train connecting a drive shaft and an output shaft and a driven pinion on the output shaft which is meshed with the crown gear. The drive unit is characterized in that the crown gear is arranged at a position substantially central to the width of the gear box, such that the crown gear is disposed above the output shaft, and a driven pinion positioning means is provided to position the pinion on the output shaft at two positions where the crown gear intersects the output shaft so as to be meshable with the crown gear.

The pull-back windup spring drive unit according to this invention is further characterized in that the crown gear is provided with a windup gear on the peripheral surface thereof and with a drive pinion on the shaft thereof so that such crown-gear windup gear is to be engaged with other co-active windup switching gear at the time of winding the spiral spring, while on the other hand, when releasing thus-wound-up spring, another co-active drive switching gear is brought to engagement with the crown-gear drive pinion.

A driven pinion may be engageable with the crown gear at either one of the two positions, right or left, intersecting the output shaft of the crown gear. The rotational direction of the output shaft may be changed by simply turning the output shaft by 180° on the axial plane so as to engage the driven pinion with the other-side gear surface the crown gear during assemblage of these elements in a gear box. More specifically, the drive unit may be utilized either for front driving or rear driving by simply changing the assembly method of the unit.

With the crown gear having a drive gear formed, the windup switching gear is directly engaged with the crown gear as the spring is wound, where as the wound-up spring is released (as the toy is being driven), the drive switching gear is then engaged with the driving gear which is rotated by the unwinding spring and meshed directly with the crown gear to rotate the output shaft. Therefore, the drive unit eliminates the third gear as found in the prior art, and can be made compact with a smaller number of parts. This invention drive unit is highly suitable for the inexpensive manufacture of small and thin drive units.

DETAILED DESCRIPTION

The structure of the drive unit according to this invention will now be described, referring to an embodiment shown in attached drawings.

Figure 1:
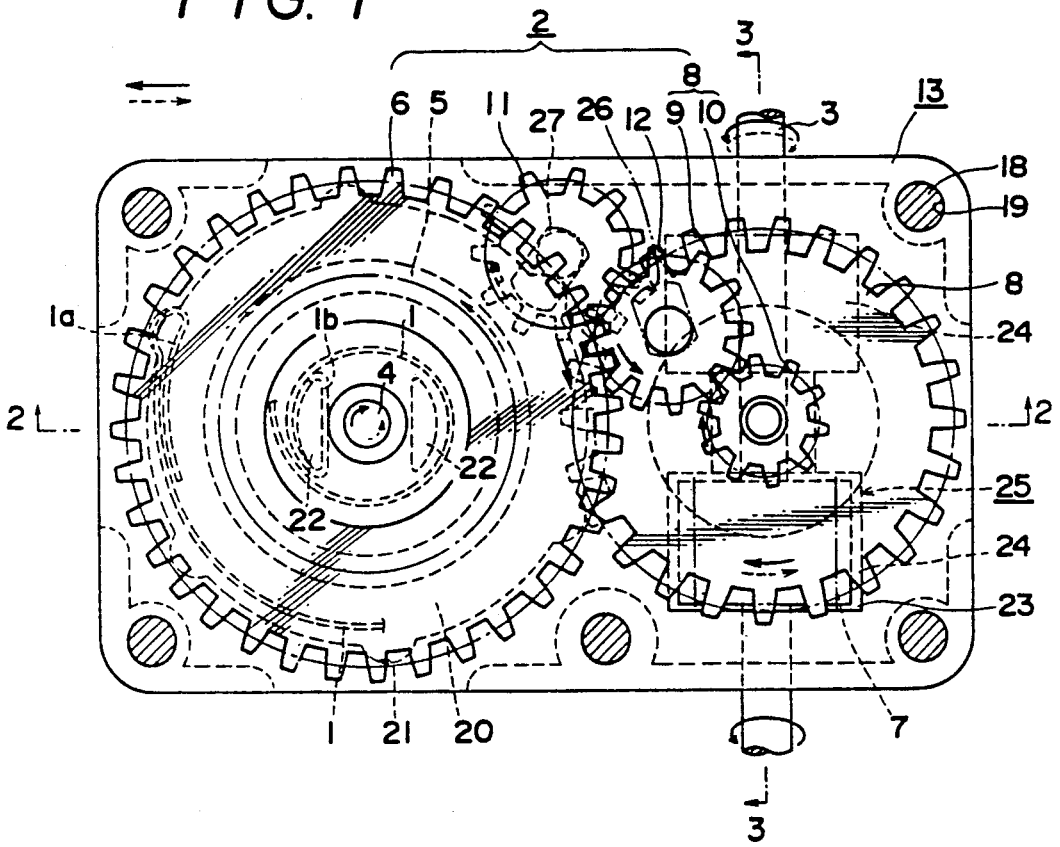
FIG. 1 is a plane view of an embodiment of the pull-back windup type spiral spring drive unit according to this invention with the upper frame removed.
Figure 2:
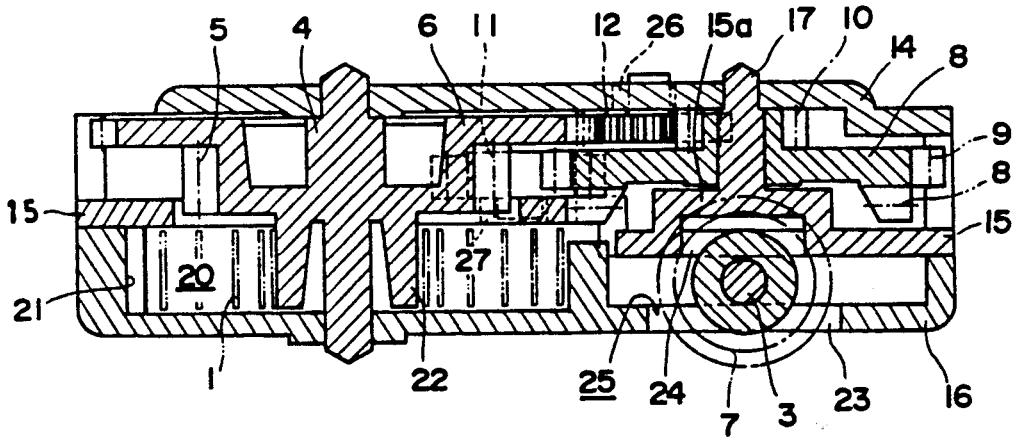
FIG. 2 is a sectional view to show the embodiment of FIG. 1 along the line 2—2.

FIG. 1 shows an embodiment of the pull-back windup type spiral spring drive unit according to this invention wherein a spiral spring 1 is used as the source of driving force, and the spiral spring 1 is connected with an output shaft 3 by a train 2 of gears. By selectively engaging gears of the gear train 2, the gear ratio is changed between the case when the revolution inputted from the output shaft 3 is transmitted to the spring 1 to be accumulated as spring force and the case when the spring force of the spring 1 is to be outputted as revolution via the output shaft 3. More particularly, the gear train 2 acts as a reduction gear train at the time of winding the spring 1 while it acts as a speedup gear train at the time of the spring 1 being unwound after having thus been wound. Although not shown in the figure, the output shaft 3 is fixedly connected to wheels as in a toy car or other applicable small mechanisms.

The gear train 2 comprises a windup pinion 5 and a driving gear 6 which are both formed integrally on a drive shaft 4 with the spiral spring 1 thereabout, a driven pinion 7 formed on the output shaft 3, a crown gear 8 whose gear-teeth are directed downwardly and meshed with the pinion 7, a crown-gear windup gear 9 formed on the peripheral surface of the crown gear 8, a crown-gear drive pinion 10 provided on the shaft of the crown gear 8, a windup switching gear 11, and a drive switching gear 12.

Figure 4:
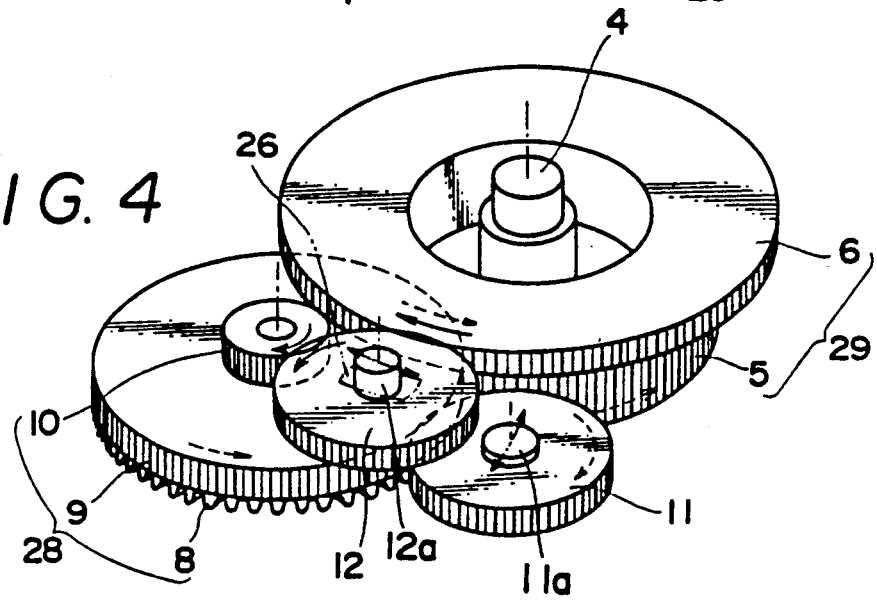
FIG. 4 is a perspective view to show a gear train.
Figure 5:
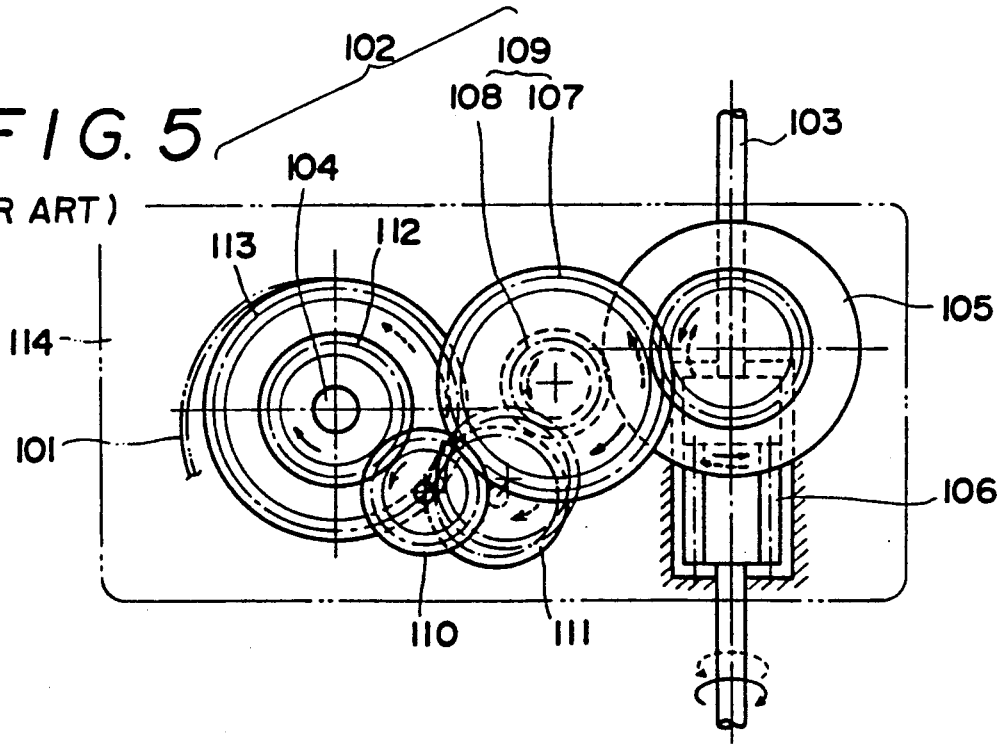
FIG. 5 (PRIOR ART)
FIG. 5 is an explanatory view to show a prior art gear train in a pull-back type spiral spring drive unit.

As shown in FIGS. 1 and 4, the crown gear 8, the crown-gear windup gear 9 and the crown-gear drive pinion 10 are molded together integrally into a first gear 28. The driving gear 6 and windup pinion 5 are integrally molded to form a second gear 29. The driving gear 6 of the second gear 29 has an outer diameter larger than that of the windup pinion 5, and the crown-gear windup gear 9 of the first gear 28, which forms the outer periphery of the crown gear 8, is positioned partly underneath the driving gear 6. The drive switching gear 12 is at its shaft movably journalled in a second elongated hole 26 of a gear box 13 which is shaped like an arc having its center at the central shaft 4 of the second gear 29, so that, when the drive unit starts to be driven, the drive switching gear 12 is brought to a complete engagement with both pinion 10 of the first gear 28 and drive gear 6 of the second gear 29, to thereby transmit the revolution of the pinion 10 to the driving gear 6. As stated hereinafter, and as shown by the solid line (→) arrow in FIG. 1, the drive switching gear 12 is therefore so adapted that, when the driving gear 6 is revolved clockwise, the gear 12 is caused to rotate over the gear in contact therewith, to thereby be brought to a complete engagement with the crown-gear pinion 10 of the first gear 28, transmitting a drive force to the driven pinion 7. The windup switching gear 11 is disposed part-way underneath the drive switching gear 12. In other words, the gear 11 is movably journalled in the first elongated hole 27 of the gear box 13 which is formed like an arc having its center at the rotation center of the first gear 28, so that, when the spring 1 is being wound up, the gear 11 is completely meshed with the crown-gear windup gear 9, rotating over the gear 9 in contact therewith, to thereby eventually be completely engaged with the windup pinion 5 of the second gear 29, at a position proximal to the drive switching gear 12. As shown with a broken line (→) arrow in the FIG. 1, by the counter-clockwise revolution of the first gear 28 at the time of winding of the spring 1, the windup switching gear 11 is caused to rotate over the gear 9 to be engaged with the windup pinion 5 of the second gear 29 to thereby transmit the winding force from the pinion 7 to the spring 1.

By structuring the device as above, the number of necessary gears may be reduced by one from the prior art, the gears can be arranged compact at a higher density within a smaller space, the height and the length of the unit may be minimized to provide a drive mechanism which is smaller and thinner.

The gear train 2 transmits revolution, when the spring 1 is being wound up, as follows: the output shaft 3→the driven pinion 7→the crown gear 8→the crown-gear windup gear 9→the windup switching gear 11→the windup pinion 5→the spring 1. When the spring 1 is unwound for driving, the gear train 2 transmits revolution as follows: the spring 1→the driving gear 6→the drive switching gear 12→the crown-gear drive pinion 10→the crown gear 8→the driven pinion 7→the output shaft 3. It is preferable that the first gear 28 is formed by molding together the crown gear 8, the windup gear 9 and the pinion 10, using such a plastic as polyacetal. Likewise, preferably, the second gear 29 is formed by molding together the driving gear 6, the windup pinion 5 and drive shaft 4, using a plastic such as polyacetal. The second gear 29 is supported rotatably on an upper frame 14 and a lower frame 16 of the gear box 13.

Figure 3:
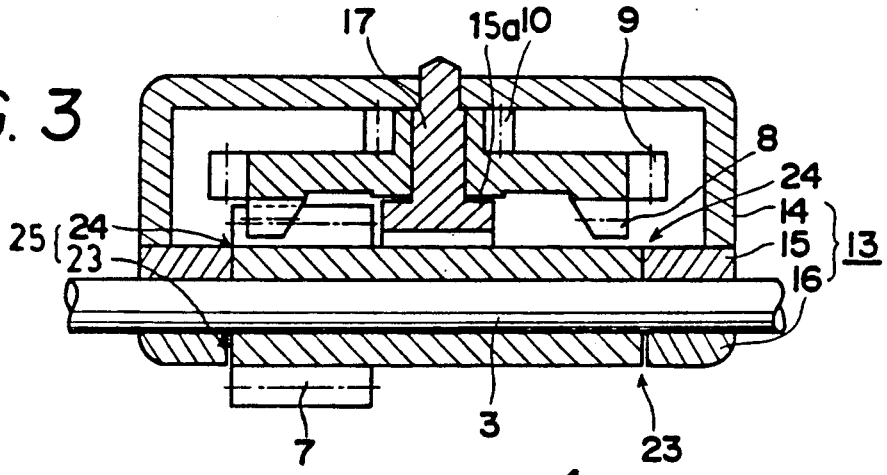
FIG. 3 is a sectional view to show the embodiment of FIG. 1 along the line 3—3.

The crown gear 8 is positioned above the output shaft 3 and substantially at a center point, width-wise of the gear box 13 in order to be engaged with the driven pinion 7 on the output shaft 3 at either side in FIG. 3. The drive shaft 4, on which is mounted the spring 1, and the crown gear 8 are positioned in parallel to each other and on the same plane perpendicular to the output shaft 3 at the substantial center of the gear box 13 or substantially at the center of the width thereof. The crown gear 8 is rotatably supported on a shaft 17 which is integrally molded with an intermediate frame 15 which is a part of the gear box 13, and is positioned on the output shaft 3.

The gear box 13 is assembled in a detachable manner with the upper frame 14 having engaging pins 18, the lower frame 16 having holes 19 to which the pins 18 are forced in, and an intermediate frame 15 which is sandwiched between the above two frames 14, 16. A spring chamber 20 is provided between the intermediate frame 15 and the lower frame 16. The spring 1 is fixedly placed in the chamber 20, such that its bent-back outer end 1*a* is fitted in a semicircular groove 21 on the wall of the chamber 20 and its inner end 1*b* is securely held between the two claws 22 formed integrally on the drive shaft 4. Accordingly, when the spring 1 is wound excessively, the spring end 1*a* comes out of the groove 21 and moves along the inner wall of the chamber 20 to limit further winding. In this connection, preferably, a plurality of semi-spherical protrusions (not show) are formed on the inner wall of the chamber 20, so that, if the spring end 1*a* comes out of the groove 21, a frictional collision occurs between the protrusions and spring end 1*a*, emitting a clicking sound to notify the completion of spring winding. The aforementioned gear train 2 is housed between the upper frame 14 and the intermediate frame 15.

The gear box 13 is provided with a driven pinion positioning means 25 for positioning the driven pinion 7 at one of the two intersecting points where the crown gear 8 intersects the output shaft 3 so as to place the driven pinion 7 in mesh with one side of the crown gear. In the illustrated embodiment, as such positioning means 25, there are perforated two positioning holes 23 and 24 on the lower and intermediate frames 16 and 15, respectively, which holes 23, 24 are adapted to receive the pinion 7 therein, thereby restricting the end face of the pinion 7 at the edge of those holes which cross the output shaft 3 at a right angle.

The hole 24 in the intermediate frame 15 lies in the width-wise direction of the gear box 13 with respect to the crown gear 8. Generally crossing over or bridging a center of the hole 24, there lies a part 15*a* of the intermediate frame 15, at which a shaft 17 is integrally formed and projects upwardly to support the crown gear 8 rotatably. Thus, symmetrically relative to and at the opposite sides of that intermediate frame part 15*a*, two spaces are defined in the hole 24 so as to partition the hole 24 on the right and left sides, as viewed from above. Consequently, one of those two spaces is defined right above and in alignment with the hole 23 of the lower frame 15, thereby creating a vertical series of spaces (23, 24) in which the driven pinion 7 is housed in a rotatable way.

The drive switching gear 12 is integraliy molded with a shaft 12*a* of plastic such as polyacetal, and is fitted, movably in a second elongated hole 26 of an arc form with the center of radius of curvature placed at the center of revolution of the driving gear 6 so that it comes into engagement with or disengagement from the crown-gear pinion 10 integral with the crown gear 8, depending on the rotational direction of the driving gear 6. More specifically, as shown in FIG. 1, when the driving gear 6 rotates clockwise (→), the drive switching gear 12 rotates counter-clockwise and, at the same time, moves within the second elongated hole 26 to come to be engaged with the pinion 10. Conversely, when the driving gear 6 is to be rotated counter-clockwise by the counter-clockwise revolution of the pinion 10, the switching gear 12 is pushed by a reaction force to slide in the hole 26 away from the pinion 10. The second elongated hole 26 is bored on the upper frame 14. The windup switching gear 11 is integrally molded with a shaft 11*a* of plastic such as polyacetal and is movably fitted in the first elongated hole 27 of an arc form with the center of the radius of curvature placed at the center of the revolution of the winding gear 9 so that it comes to engagement or disengagement with or from the windup pinion 5 of the drive shaft 4, depending on the rotational direction of the windup gear 9. More particularly, as shown in FIG. 1, when the gear 9 rotates counter-clockwise, the gear 11 rotates clockwise and at the same time moves within the first elongated hole 27 to be engaged with the windup pinion 5. Conversely, when the gear 9 is to be rotated clockwise by the clockwise rotation of the windup pinion 5, the gear 11 pushed away by the reaction force from the pinion 5 within the first hole 27. The first elongated hole 27 is bored on the intermediate frame 15.

The operation of the driving unit with the structure mentioned above according to this invention will now be described below.

When a toy such as a toy car which is mounted with this invention driving unit is rubbed by hand against the floor to move in the direction shown by an arrow (→) in FIG. 1, the output shaft 3 is pulled back to rotate the crown gear 8 in the direction shown by an arrow (→), which in turn causes the windup switching gear 11 to come to mesh with the windup pinion 5 completely and transmits the rotation thereof to the drive shaft 4 to thereby wind up the spiral spring 1. When the spiral spring 1 has been wound for a predetermined amount, the end 1*a* of the spring 1, which is not restricted, comes out of the groove 21 and rotates idly in the chamber 20 to notify that the winding operation should be stopped. Then, when the toy car is released, the spring 1 is freed to rotate the drive shaft 4 in the direction shown by an arrow (→). This places the gear 11 in an incomplete mesh with the windup pinion 5, resulting in an idly rotating state of the former gear 11, and at the same time, which causes the gear 12 to completely engage the pinion 10 of the crown gear 8. Accordingly, the rotation of the drive shaft 4 is transmitted as follows: the driving gear 6→the drive switching gear 12→the crown-gear pinion 10→the crown gear 8→the driven pinion 7→the output shaft 3. As a result, the toy car is driven in the direction of the arrow (→). If the output shaft 3 is turned by 180° on the axial plane at assembly time, the above mentioned rotation will be reversed. The spring 1 may be wound up by rotating the output shaft in the direction of the arrow (→) and the toy car is driven in the direction of the arrow (→).

While the above-described embodiment is a preferred one for the present invention, it should be understood that the invention is not limited thereto, but may be modified in various ways without departing from the spirit and scope of the accompanying claims. For instance, the positioning means 25 for driven pinion 7 are not limited to aforementioned holes 23, 24, but may be pins of a fork shape or brackets which abut against the gear face or the boss face of the driven pinion 7, or may be a recess which flexibly restricts the driven pinion 7 so far as it has the structure and means to house the pinion in engagement at either of the two points where it intersects the output shaft 3 of the crown gear 8.

What is claimed is:

1. A pull-back windup type spiral spring drive unit comprising at least a drive shaft on which a spiral spring is wound, an output shaft, a driven pinion fixed on said output shaft, and a crown gear engaged with said driven pinion and including a gear train connecting said drive shaft with said output shaft and a gear box supporting these components, wherein the spring is wound up by the reverse rotation of said output shaft and said output shaft is rotated by a spring force accumulated in said spiral spring, characterized in that said crown gear is provided on the peripheral surface thereof with a windup gear and on the shaft thereof with a pinion so that said windup gear is engaged with a windup switching gear at a time of winding said spiral spring, and said pinion is directly engaged with a drive switching gear at a time of driving.

2. The pull-back windup type spiral spring drive unit as claimed in claim 1, characterized further in that said crown gear, said windup gear formed on the periphery thereof and the pinion formed on the shaft thereof are molded integrally.

3. The pull-back windup type serial spring drive unit as claimed in claim 1, characterized in that said crown gear, said windup gear formed on the periphery of said crown gear, and said pinion formed axially on said crown gear are molded integrally to form a first gear, that said gear train includes a driving gear and a windup pinion which are molded integrally to form a second gear, that between the first and second gears, are arranged a windup switching gear movably housed within a first elongated hole in the form of an arc with the center a radius of curvature thereof placed at the center of rotation of said first gear and a drive switching gear housed movable within a second elongated hole in the form of an arc with the center of a radius of curvature thereof placed at the center of rotation of said second gear, said windup switching gear is caused to rotate on said windup gear with the revolution of said first gear at the time of winding to be engaged with the windup pinion, said drive switching gear is caused to rotate on said drive gear by the revolution of said second gear at the time of driving to be engaged with the pinion of said first gear.

4. The pull-back windup type spiral spring drive unit as claimed in claim 3, characterized further in that said gear box comprises an upper frame and a lower frame which are snapped in with projections and recesses thereon and an intermediate frame which is held therebetween, said first gear is engaged at its center with a shaft which is molded integrally with said intermediate frame to be rotatably supported thereby, said second gear is axially engaged rotatably on a shaft thereof with said upper and lower frames, said first elongated hole supporting said windup switching gear is provided on said intermediate frame while said second elongated hole supporting said drive switching gear for running is provided on said upper frame, and the lower frame is provided with a space which houses said spiral spring.

5. A pull-back windup type spiral spring drive unit comprising:

a gear box having a length, a width and a thickness;

a drive shaft on which a spiral spring is wound, mounted for rotation to said gear box;

an output shaft mounted for rotation to said gear box;

a driven pinion fixed on said output shaft;

a crown gear mounted for rotation to said gear box and meshed with said driven pinion, said crown gear being positioned at the substantial center of the width of said gear box;

a gear train supported by said gear box and connecting said drive shaft with said output shaft, said gear train having a windup switching gear engageable between said output shaft and said drive shaft so that said spiral spring is wound up by a reverse rotation of said output shaft, and a drive switching gear engageable between said drive shaft and said output shaft so that said output shaft is rotated in a forward direction by a spring force accumulated in said spiral spring after it is wound up;

driven pinion positioning means connected to said gear box for setting said driven pinion of said output shaft at two locations meshed with said crown gear so that rotation of said output shaft in one direction rotates said crown gear in one direction at one of said two locations and in an opposite direction at the other of said two locations; and said crown gear including a windup gear formed on a periphery of said crown gear and a pinion formed axially on said crown gear, said windup gear and pinion being molded integrally to form a first gear, said gear train including a driving gear and a windup pinion, said driving gear and windup pinion being molded integrally to form a second gear, said windup switching gear being engaged between said first and second gears, said gear box having a first elongated hole in the form of an arc with a center of radius of curvature thereof at the center of rotation at said first gear, said windup switching gear being movably housed within first elongated hole, said drive switching gear being engaged between said first and second gears, said gear box having a second elongated hole in the form of an arc with the center of radius of curvature thereof at the center of rotation of said second gear, said drive switching gear being housed for movement in said second elongated hole. driven pinion.

6. The pull-back windup type spiral spring drive unit as claimed in claim 5, wherein said driven pinion positioning means comprises a member which abuts against either a gear end face or a boss end face of the driven pinion so as to prevent axial displacement thereof.

7. The pull-back windup type spiral spring drive unit as claimed in claim 5, wherein said gear box comprises an upper frame and a lower frame which are snapped into each other by projections and recesses provided thereon and an intermediate frame held between the upper and lower frames, and said driven pinion positioning means comprises said lower frame which houses said driven pinion and a boss thereof and which has bored symmetrical holes in the direction of the width and said intermediate frame which partly abut against an end face of said driven pinion.

* * * * *